United States Patent [19]

Kemp et al.

[11] 4,046,520

[45] * Sept. 6, 1977

[54] GASOLINE PRODUCTION

[75] Inventors: Jacob D. Kemp, El Cerrito; Robert P. Sieg, Piedmont, both of Calif.

[73] Assignee: Chevron Research Company, San Francisco, Calif.

[ * ] Notice: The portion of the term of this patent subsequent to Sept. 9, 1992, has been disclaimed.

[21] Appl. No.: 585,412

[22] Filed: June 9, 1975

Related U.S. Application Data

[63] Continuation of Ser. No. 306,117, Nov. 13, 1972, Pat. No. 3,904,384, which is a continuation-in-part of Ser. No. 31,300, April 23, 1970.

[51] Int. Cl.[2] ..... C10L 1/02

[52] U.S. Cl. ..... 44/56

[58] Field of Search ..... 44/56; 260/683, 641, 260/614 A

[56] References Cited

U.S. PATENT DOCUMENTS

| | | | |
|---|---|---|---|
| 2,803,667 | 11/1957 | Chambers | 260/614 A |
| 2,813,908 | 11/1957 | Young | 260/614 A |
| 2,816,150 | 12/1957 | Hepp | 260/683 |
| 2,848,522 | 8/1958 | Gilmore | 260/683 |
| 2,861,045 | 11/1958 | Langer, Jr. | 260/614 A |
| 2,891,999 | 6/1959 | Langer, Jr. | 260/614 A |
| 3,224,848 | 12/1965 | Henderson | 44/56 |
| 3,285,977 | 11/1966 | Henke et al. | 260/614 A |
| 3,482,952 | 12/1969 | Sieg et al. | 44/56 |

*Primary Examiner*—Daniel E. Wyman
*Assistant Examiner*—Mrs. Y. Harris-Smith
*Attorney, Agent, or Firm*—D. A. Newell; R. H. Davies

[57] ABSTRACT

A process for producing a high-octane gasoline having reduced smog-forming tendencies, which comprises:

a. thermally dehydrogenating-cracking isobutane to obtain propylene and isobutene;
b. hydrating propylene to obtain isopropanol;
c. etherating the isopropanol with the isobutene to obtain t-butyl isopropyl ether; and
d. blending the t-butyl isopropyl ether with gasoline-boiling-range hydrocarbons.

Preferably the thermal dehydrogenation is carried out under conditions, specifically including a temperature between about 1125° and 1275° F., to produce a molar ratio of isobutene to propylene between 1.0 and 1.25.

1 Claim, 2 Drawing Figures

GASOLINE PRODUCTION

This is a continuation of application Ser. No. 306,117, filed Nov. 13, 1972 now U.S. Pat. No. 3,904,384, which in turn is a continuation-in-part of Ser. No. 31,300 filed Apr. 23, 1970.

BACKGROUND OF THE INVENTION

1. Field of the Invention

The present invention relates to a process for the production of high-octane gasoline, which gasoline may contain no lead additive or very little lead additive. More particularly, the present invention is an integrated process involving paraffin dehydrogenation, olefin hydration, etheration and gasoline blending.

2. Prior Art and Related Disclosures

Gasoline compositions comprising dialkyl ethers have been disclosed in the prior art; for example, in U.S. Pat. No. 3,168,385 a motor fuel composition containing dialkyl ethers is disclosed. The fuel compositions disclosed in U.S. Pat. No. 3,168,385 include a saturated aliphatic hydrocarbon base stock in an amount from about 50% to about 90% by volume of the blend, a small amount of tetraethyl lead, a small amount of an alkyl ester of a $C_2$ to $C_8$ carboxylic acid, and a small amount of dialkyl ether. According to U.S. Pat. No. 3,168,385, preferably the ether is tertiary butyl methyl ether or diisopropyl ether.

There have not been a very large number of over-all processes disclosed for the production of etherated gasolines starting from the base feedstocks. However, an over-all process for the production of gasoline is disclosed in U.S. Pat. No. 3,482,952. According to the process disclosed in U.S. Pat. No. 3,482,952, a basic step in the over-all gasoline production process is the cracking of a hydrocarbon feedstock. The effluent from the cracking zone is fractionated into a plurality of streams, including at least a first stream and a second stream. The first stream boils in the range of about 15° to 170° F. and contains the major portion of the $C_4$ to $C_6$ tertiary olefins present in the cracking zone effluent. This first stream is contacted with a lower alcohol in the presence of an etheration catalyst to convert tertiary olefins in the first stream to ethers. Then the ether-containing first stream is conbined with at least one hydrocarbon stream boiling in the range of about 15° to 425° F. to form a gasoline.

Methods for producing high-octane gasolines of reduced smog-forming tendencies in addition to those involving hydrocarbon cracking are desirable in view of the wide variety of gasoline-producing methods, including catalytic reforming, alkylation such as HF alkylation or $H_2SO_4$ alkylation, hydrocracking, distillation of crude oil to obtain straight-run gasoline, and other methods.

SUMMARY OF THE INVENTION

According to the present invention, an integrated process is provided for producing a high-octane gasoline having reduced smog-forming tendencies, which process comprises:

a. thermally dehydrogenating-cracking isobutane to obtain a mixture of propylene and isobutene;
b. separating the mixture into an isobutene-rich stream and a propylene-rich stream;
c. hydrating the propylene-rich stream to obtain isopropanol;

d. etherating the isopropanol with the isobutene-rich stream to obtain t-butyl isopropyl ether; and
e. blending the t-butyl isopropyl ether with gasoline-boiling-range hydrocarbons.

In the process of the present invention, it is particularly preferred to carry out the thermal dehydrogenation under conditions, specifically including a temperature between about 1125° and 1275° F., to produce a molar ratio of isobutene to propylene between 1.0 and 1.25.

It has been found that for an isobutane feedstock, approximately equal molar amounts of propylene to isobutene up to about 1.25 moles of isobutene to propylene can be obtained by thermal dehydrogenation-cracking of the isobutane feedstock at a temperature within the range of 1125° to 1275° F., and, more preferably, within the range of about 1175° to 1235° F. This particular aspect of the present invention is discussed further herein-below with respect to FIG. 2. It is to be understood that the term "dehydrogenation-cracking" is used herein to connote a combination of dehydrogenation and cracking that produces both isobutenes and propylenes.

Feed to the dehydrogenation step of the present invention can be any of several isobutane hydrocarbon streams produced in refinery processes. In general, a substantially isobutane feed is composed mainly (at least 55 mol percent) of isobutane plus minor amounts of propane, n-butane and pentane fractions. For example, in hydroconversion processes — particularly hydrocracking — substantial quantities of normal butane and isobutane are commonly produced. The isobutane may be fractionated from other hydrocarbons and then fed to the thermal dehydrogenation-cracking step of the process of the present invention. However, it is preferred in the process of the present invention to more fully utilize light hydrocarbon streams composed of normal butane and isobutane by processing them through a deisobutanizer and normal-butane-isomerization reactor, as is schematically indicated in FIG. 1. Thus, according to a preferred embodiment of the present invention, the isobutane feedstock to the thermal dehydrogenation-cracking step is obtained at least in part by isomerization of normal butane.

The propylene produced by isobutane dehydrogenation-cracking is hydrated to produce isopropanol. The propylene hydration step in the process of the present invention is carried out by contacting a mixture of the propylene and $H_2O$ with a solid acidic hydration catalyst, preferably an acidic sulfonated resin catalyst, at a temperature between 100° and 400° F., and at a pressure between 10 and 1500 psig. It is particularly preferred in the process of the present invention to carry out the propylene hydration step in a nonferrous reaction zone. Iron has been found to poison the preferred acidic sulfonated polymeric resin catalysts used in the process of the present invention.

A particularly preferred sulfonated resin catalyst for use in the hydration step of the present invention is Amberlyst 15®, manufactured by Rohm and Hass Company.

Other preferred operating conditions for the propylene hydration step of the present invention are discussed in more detail in application Ser. No. 21,360, entitled "Olefin Conversion," filed by Jacob D. Kemp on Mar. 20, 1970, the disclosure of which patent specification is incorporated by reference into the present patent specification.

In the process of the present invention, the etheration of the isopropanol with the isobutene to obtain tertiary butyl isopropyl ether is carried out by contacting a mixture of the isopropanol and isobutene with a solid acidic etheration catalyst, preferably a sulfonated resin catalyst, in a reaction zone at a temperature between about 50° and 200° F.

In the process of the present invention, a hydrocarbon feedstock, preferably boiling within the gasoline boiling range, is blended with the tertiary butyl isopropyl ether to produce high-octane gasoline. By "gasoline-boiling-range hydrocarbons" is meant those hydrocarbons boiling at least within the range of 15° to 500° F., and, more usually, within the range of about 50° to 400° F. Preferred gasoline-boiling-range hydrocarbons for blending with the tertiary butyl isopropyl ether, according to the process of the present invention, include catalytic reformate, catalytic hydrocrackate, acid-alkylation alkylate, catalytically cracked gasoline, and crude-oil-distillation straight-run hydrocarbons.

According to a particularly preferred embodiment of the present invention, a process is provided for producing a high-octane gasoline having reduced smog-forming tendencies which comprises:

a. thermally dehydrogenating-cracking isobutane under conditions, specifically including a temperature between about 1185° and 1215° F., to produce a molar ratio of propylene to isobutene between about equal molar amounts of propylene to isobutene and 1.25 mols isobutene to 1.0 mol of propylene;

b. separating effluent from the thermal dehydrogenation-cracking step into a propylene-rich stream and an isobutene-rich stream;

c. hydrating the propylene-rich stream by contacting a mixture of the propylene-rich stream and water with an acidic sulfonated resin catalyst at a temperature between about 100° and 400° F. to obtain isopropanol;

d. etherating the isobutene with the resulting isopropanol, using a sulfonated resin catalyst having an acidity between 2 and 6 meq. of H+ per gram of catalyst, to obtain t-butyl isopropyl ether; and e. blending the t-butyl isopropyl ether with a hydrocarbon boiling in the gasoline range.

DETAILED DESCRIPTION OF THE DRAWINGS

Figure 1:
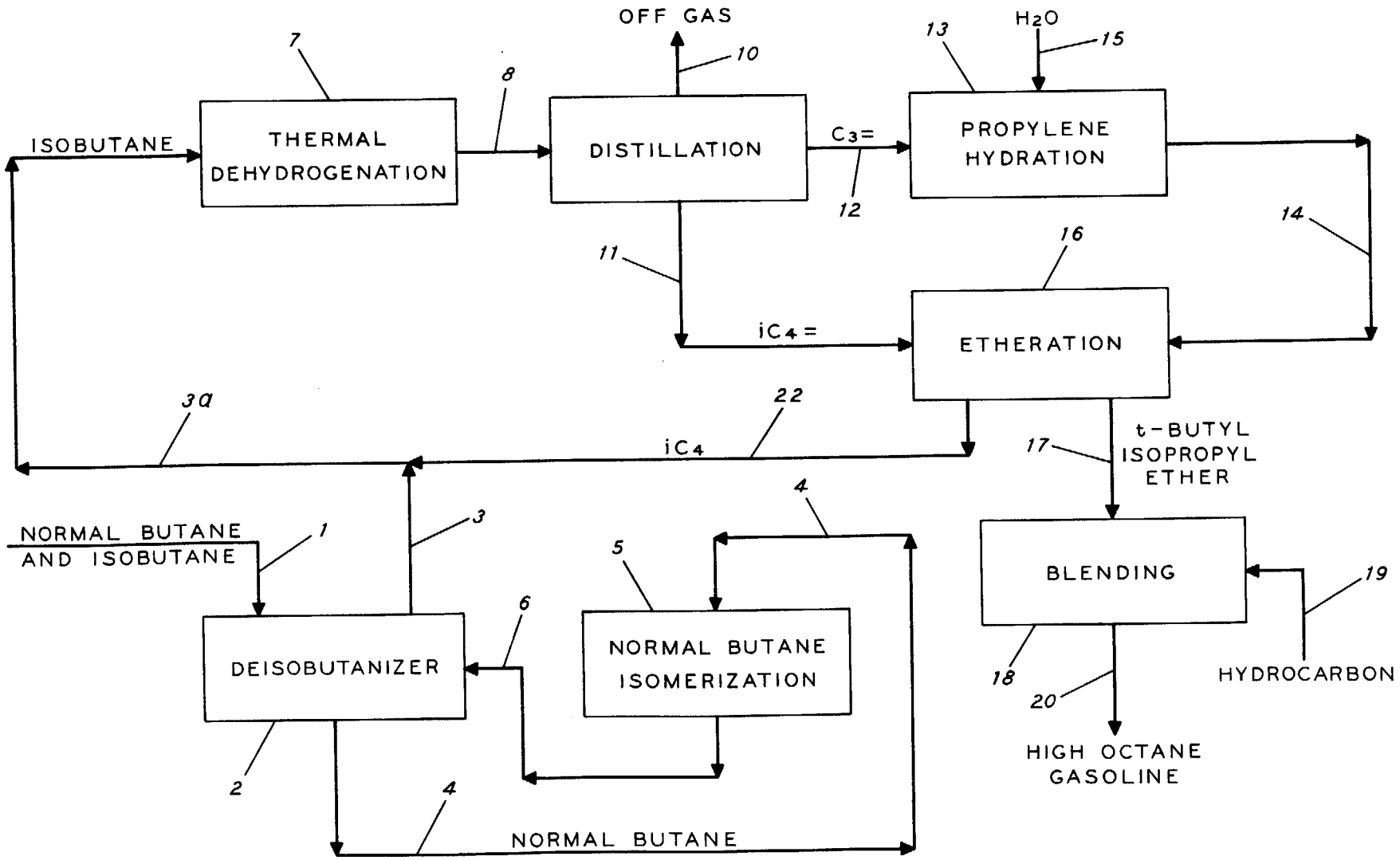
FIG. 1 is a schematic process flow diagram illustrating a preferred embodiment of the combination process of the present invention.

Referring now to FIG. 1, the feed stream to the process of the present invention can begin, for example, at either line 1 or line 3. That is, a refinery hydrocarbon stream rich in isobutane may be fed directly via line 3 to thermal dehydrogenation zone 7. However, as indicated above, it is preferred in many instances to obtain the isobutane feedstock for the thermal dehydrogenation-cracking step of the present invention by isomerization of a feed stream containing normal butane. Thus, according to a preferred embodiment of the present invention, a feed stream comprising normal butane and isobutane is fed via line 1 to deisobutanizer zone 2. Deisobutanizer zone 2 consists primarily of a deisobutanizer column and related equipment. Isobutane is distilled overhead in the deisobutanizer fractionation column and is ultimately passed via line 3 to dehydrogenation zone 7. The normal butane bottoms material from the deisobutanizer fractionation column is ultimately passed via line 4 to isomerization zone 5.

It is to be understood that the blocks used to indicate the process of the present invention in FIG. 1 are schematic only, and that many of the minor processing steps are not shown.

The normal butane feed to isomerization zone 5 is preferably mixed with hydrogen, heated and charged at moderate pressure to a reactor. Preferably the butane feed is contacted with a platinum-on-alumina catalyst in the reactor. The reactor effluent is cooled, hydrogen and light gases are separated from the liquid in a separator for recycling via a compressor, and the liquid then is stabilized in a conventional distillation column. The stabilized bottoms product is deisobutanized by passing the bottoms product via line 6 to deisobutanizer zone 2. High-purity isobutane is taken overhead together with any isobutane introduced in the fresh feed via line 1 to desiobutanizer zone 2. The isobutane stream is fed via line 3 to thermal dehydrogenation zone 7. Further description of the isomerization and related deisobutanizer step of the present invention can be found in "The Oil and Gas Journal," Vol. 56, No. 13, Mar. 31, 1958, pp. 73–76. This last-mentioned disclosure is incorporated by reference into the present patent specification.

The thermal dehydrogenation-cracking step of the present invention is carried out at a temperature above 1100° F., and preferably above 1150° F. Catalysts can be used in the thermal dehydrogenation-cracking step. Thus, for purposes of the present patent application, thermal dehydrogenation is defined as dehydrogenation at a temperature above 1100° F. in the presence or absence of catalysts. In accordance with a preferred embodiment of the present invention, the thermal dehydrogenation-cracking step is noncatalytic, thereby avoiding the expense of using catalysts such as $Cr_2O_3$—$Al_2O_3$.

In the process of the present invention, a mixture of propylene and isobutene is obtained from the thermal dehydrogenation-cracking step. As can be seen from FIG. 2, there is little propylene product at temperatures below 1100° F., under the conditions employed to generate the dehydrogenation data graphically presented in FIG. 2. Yields of propylene are substantially limited at temperatures below about 1100° F. by equilibrium factors. The data shown in FIG. 2 were obtained under the following reaction conditions:

| | |
|---|---|
| Feed | 88 wt.% isobutane<br>12 wt.% n-butane |
| Pressure | 47 psig |
| Liquid hourly space velocity (LHSV) | 0.833 |
| Wt.% conversion of the feed | 40% |
| Volumetric hydrogen-to-hydrocarbon ratio | 1.90 |
| Catalyst | $Cr_2O_3$-$Al_2O_3$-$K_2O$ |
| Surface area of catalyst | 76 $m^2/g$. |

Figure 2:
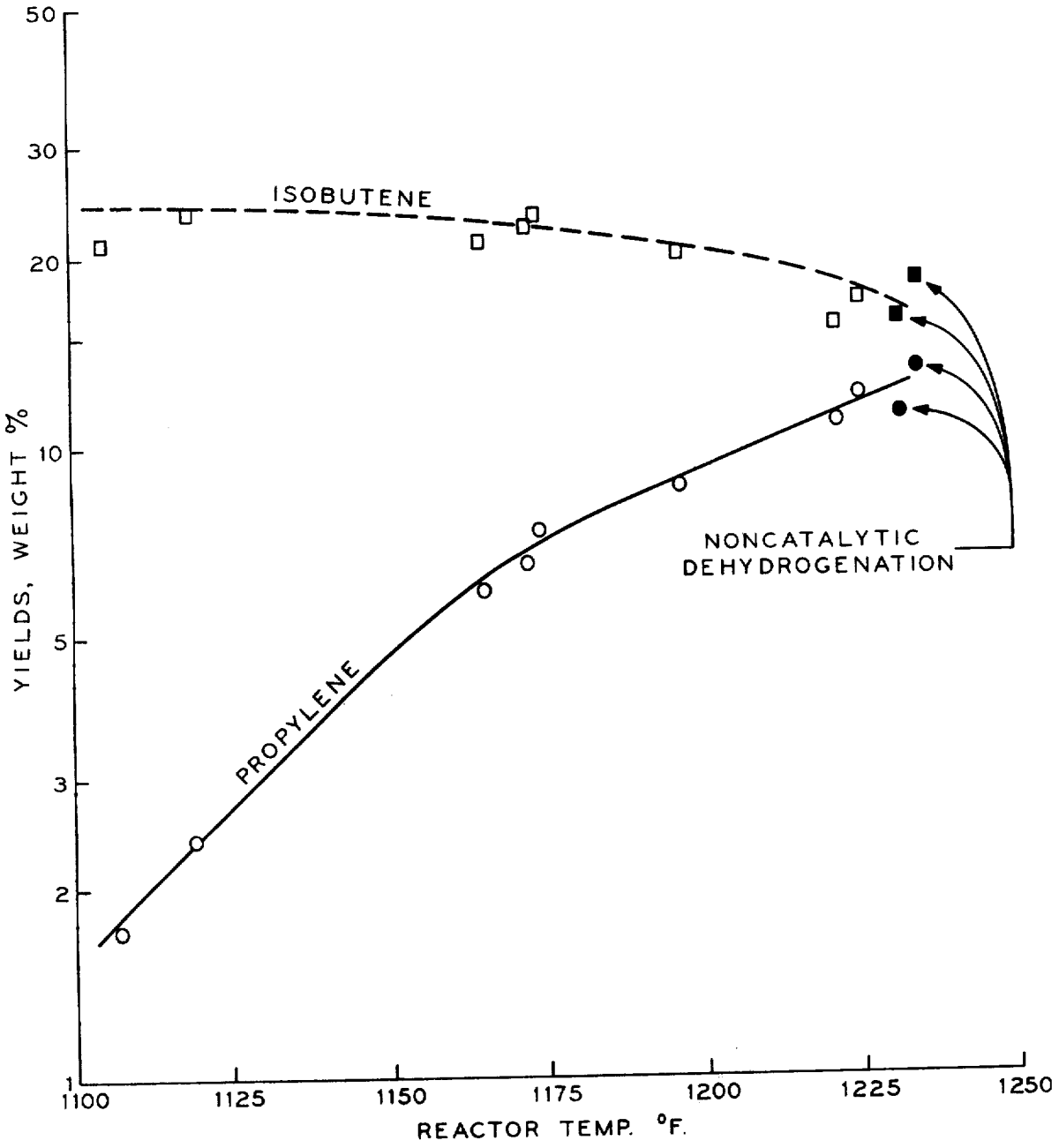
FIG. 2 is a graph pertaining to the dehydrogenation-cracking step in the present invention, and showing the yields of isobutene and propylene from isobutane dehydrogenation-cracking at various temperatures.

As can be seen from FIG. 2, the amount of isobutene produced in the laboratory dehydrogenation reaction decreased somewhat with the increasing temperature over the range 1100° to about 1230° F. Conversely, the amount of propylene produced increased over the same temperature range. At about 1230° F., approximately 13 weight percent propylene was produced, and about 17 weight percent isobutene was produced. This corresponds to an approximately equal molar ratio of propylene to isobutene. As will become more apparent from the further description herein-below, it is preferred in the process of the present invention to produce approximately equal molar amounts of isobutene and propylene in the thermal dehydrogenation-cracking step, up to about 1.25 mols of isobutene per mol of propylene. Preferred temperatures to accomplish the desired production of isobutene and propylene are within the range 1125° to 1275° F., and it is particularly preferred to operate within the range of about 1175° to 1230° F.

As is indicated by the solid dots at the end of the curves for propylene and isobutene in FIG. 2, noncatalytic cracking was used to obtain data points at a Temperature of about 1230° F. The material used in the high-temperature laboratory reactor was alundum chips, the alundum being a fused alumina having very little surface area and essentially no catalytic activity. As can be seen, these noncatalytic cracking points coincided well with the curves for the data obtained over the temperature range of about 1100° to 1125° F. using the chromia-alumina catalyst. This may be expected, particularly at the higher temperature range, where the thermal-cracking nature of the dehydrogenation reaction is of particular importance. As indicated previously, in the process of the present invention it is required that a relatively high temperature be used in the dehydrogenation-cracking step. However, a catalytic or a non-catalytic material may be used in the dehydrogenation reactor or furnace, so long as the required ratio of isobutene to propylene is produced.

The runs which were used to obtain the data graphically presented in FIG. 2 were carried out with hydrogen added to the dehydrogenation reactor along with the isobutane feedstock. The hydrogen aids in reducing the fouling rate in the dehydrogenation reactor. The hydrogen also would have some effect equilibrium-wise in inhibiting the formation of olefins in the dehydrogenation reaction. However, it is believed that temperature is the dominant factor involved in controlling the amount of propylene obtained in the dehydrogenation reaction. Considering the data points at about 1230° F., it is expected that if hydrogen were not present in the feed, approximately the same ratio of isobutene to propylene could be obtained by lowering the temperature approximately 10° or 15° F. The yields of propylene and isobutene may be maintained while doubling the LHSV by a compensating increase in temperature, from about 1230° F. to 1250° F. Given the data of the present application, minor changes in the operation of the dehydrogenation-cracking step and other steps of the present invention can be made without departing from the spirit or scope of the present invention.

The effluent from thermal dehydrogenation zone 7 is passed via line 8 to distillation zone 9. In distillation zone 9, the dehydrogenation zone effluent is separted into an off-gas fraction which is rich in hydrogen and light hydrocarbons. The off-gas fraction is withdrawn via line 10. An isobutene-rich fraction is withdrawn via line 11 from distillation zone 9, and a propylene-rich stream is withdrawn via line 12.

The propylene is hydrated in hydration zone 13 by reacting propylene with water over an acidic solid catalyst. Preferred catalysts include phosphonated or sulfonated acidic resins. Sulfonated resins such as Amberlyst 15®, manufactured by Rohm and Haas, are particularly preferred. It is also preferred to carry out the propylene hydration reaction in a nonferrous reactor, as it has been found that iron is a catalyst poison for the sulfonated resin catalyst.

Isopropanol produced in propylene hydration zone 13 is withdrawn via line 14 and ultimately blended with isobutene withdrawn from distillation zone 9 via line 11. The isopropanol and isobutene are passed to etheration zone 16, wherein they are reacted to form t-butyl isopropyl ether. Preferably the etheration reaction is catalytically carried out by contacting the isopropanol and isobutene with an acidic solid catalyst, such as a phosphonated or sulfonated resin in the acid form.

Preferred etheration catalysts for use in the process of the present invention are relatively high-molecular-weight, water-insoluble, carbonaceous materials containing an appreciable amount of $-SO_3H$ groups per 100 grams of the solid as th acidic functionality. These catalysts are examplified by the sulfonated coals (Zeo-Karb H®, Nalcite X® and Nalcite AX®), produced by the treatment of bituminous coals with sulfuric acid and commercially marketed as zeolitic water softeners or base exchangers. These materials are usually available in neutralized form, and in this case must be converted to the hydrogen form by treatment with a mineral acid, such as hydrochloric acid, and water-washed to remove sodium and chloride ions prior to use. Also suitable are the sulfonated resin-type catalysts, which include the reaction products of phenolformaldehyde resins with sulfuric acid (Amberlite IR-1®, Amberlite IR-100® and Nalcite MX®). Also useful are the sulfonated resinous polymers of coumarone-indene with cyclopentadiene, sulfonated polymers of coumarone-indene with furfural, sulfonated polymers of coumarone-indene with cyclopentadiene and furfural, and sulfonated polymers of cyclopentadiene with furfural. The most preferred cationic exchange resins are strongly acidic exchange resins consisting essentially of sulfonated polystyrene resin, for instance a divinylbenzene cross-linked polystyrene matrix having about 0.5 to 20%, preferbly about 4 to 16%, of copolymerized divinylbenzene therein to which are attached nuclear sulfonic acid groups. These resins are manufactured and sold commercially under various trade names, e.g., Dowex 50®, Nalcite HCR® and Amberlyst 15®.

Amberlyst 15® is a particularly preferred catalyst for use in the etheration step of the present invention. Amberlyst 15® has a divinylbenzene cross-linked polystyrene matrix, having between 0.5–20% of copolymerized divinylbenzene by weight of the resin catalyst to which are attached sulfonate groups, and having a macroreticular structure. More specifically, Amberlyst 15® has the following properties:

| Property | Amberlyst 15® |
|---|---|
| Appearance | Hard, spherical, dark brown particles, toluene-saturated |
| Typical particle size distribution, percent retained on | |
| 16 mesh U.S. Standard Screens | 2.4 |
| -16+20 mesh U.S. Standard Screens | 24.2 |
| -20+30 mesh U.S. Standard Screens | 47.9 |
| -30+40 mesh U.S. Standard Screens | 18.8 |
| -40+50 mesh U.S. Standard Screens | 5.7 |
| Through 50 mesh, % | 1.0 max. |
| Whole bead content, % | 100 |
| Bulk density, g./l. as supplied lbs./cu.ft. | 850 |
| True density, g./ml., as supplied | 1.4 |
| Moisture, wt.% | <1% |
| Solids, % | 55–60 |

-continued

| Property | Amberlyst 15 |
|---|---|
| Percentage swelling from dry state to solvent-saturated state: | |
| hexane | 12 |
| toluene | 15 |
| ethylene dichloride | 17 |
| ethyl acetate | 35 |
| ethyl alcohol (95%) | 66 |
| water | 66 |
| Hydrogen ion concentration | |
| meq./g. dry | 4.9 |
| meq./ml. packed column | 2.4 |
| Surface area, $m^2/g$. | 40–50 |
| Porosity, ml. pore/ml. bead | 0.30–0.35 |
| Average pore diameter, Angstroms | 200–600 |

As can be seen from the properties given above, Amberlyst 15® is generally obtained with a hydrogen ion concentration (—$SO_3H$ concentration) of about 4.9 meq. per gram of catalyst.

The relatively high acidity of Amberlyst 15® is preferred in the process of the present invention. Particularly, acidities in the range of about 2 to about 6 meq. of H+ per gram of catalyst are preferred for the catalyst used in the etheration step of the present invention.

The tertiary butyl isopropyl ether produced in zone 16 is withdrawn via line 17 and passed to blending zone 18. In blending zone 18, the ether is blended with a gasoline-boiling-range hydrocarbon introduced via line 19. Table I below illustrates the relatively high octanes which can be obtained by blending tertiary butyl isopropyl ether with gasoline-boiling-range hydrocarbons. In particular, Table I illustrates the advantage of tertiary butyl isopropyl ether as a blending component in contrast to other components such as diisopropyl ether or tertiary butyl alcohol.

TABLE I

Linear Blending Octane Numbers of Ethers and Alcohols (Linear Blending Octanes in 10% Blend with Gasoline)

| | F-1 | F-2 |
|---|---|---|
| T-butyl isopropyl ether, TML g/Gal. | | |
| 0 | 113.9 | 103.2 |
| 1.5 | 118.3 | 108.9 |
| 2.5 | — | 111.9 |
| Diisopropyl ether, TML g/Gal. | | |
| 0 | 107.6 | 99.9 |
| 3 | 113.8 | 110.2 |
| T-butyl alcohol, TML g/Gal. | | |
| 0 | 104.1 | 89.7 |
| 3 | 114.8 | 98.4 |

EXAMPLE 5,350 barrels per calendar day of mixed butanes are passed via line 1 to deisobutanizer 2 so that normal butanes may be isomerized in zone 5. The mixed butanes are composed of 55.8% normal butane and 44.2% isobutane. The total amount of isobutane which is ultimately withdrawn via line 3 is 4,790 barrels per calendar day. The isobutane is sent to thermal dehydrogenation zone 7.

Thermal dehydrogenation reactor effluent is separated into 3 streams, an off-gas of $H_2$, $C_1$ and $C_2$'s, a $C_3$ cut rich in propylene, and a $C_4$ cut containing isobutene and unreacted isobutane.

The $C_3$ cut is sent to a hydration plant in which the propylene is hydrated to make high-purity isopropyl alcohol. The compositon of the $C_3$ cut is approximately 12,590 lbs./hr. of propylene, 2,050 lbs./hr. of propane, and 1,150 lbs./hr. of $C_2$'s + $C_4$'s. The $_3C_3$ is combined with about 13,250 lbs./hr. of demineralized water and passed to a reactor at about 500 psig and 250° F. The catalyst used in the reactor is Amberlyst 15®, having an acidity of about 5.0 meq. of H+ per gram of catalyst. The reactor effluent is fractionated to obtain about 17,240 lbs./hr. of isopropanol.

The isobutene stream from thermal dehydrogenation-cracking (after separating an off-gas stream and a propylene stream in distillation zone 9) contains about 20,850 lbs./hr. of isobutene, 38,350 lbs./hr. of isobutane, and about 4,000 lbs.hr. of other hydrocarbons. In FIG. 1, this isobutene stream is shown as being passed to etheration zone 16 via line 11. It is preferred to carry out further distillation of this isobutene stream, as is indicated in this example. The distillation of the isobutene stream can be considered as part of etheration zone 16. Thus, it is preferred to pass the isobutene stream to a deisobutanizer fractionation column wherein isobutane is distilled overhead for recycle to thermal dehydrogenation zone 7 via line 22. A bottoms stream rich in isobutene is withdrawn from the bottom of the deisobutanizer. This isobutene-rich bottoms stream from the deisobutanizer is passed to a relatively small rerun column. A normal-butane-rich stream amounting to about 3,000 lbs./hr. is withdrawn from the bottom of the small rerun column and about 20,300 lbs./hr. of isobutene is withdrawn from the top of the rerun column.

This isobutene is combined with isopropanol fed via line 14 to the etheration zone and passed downflow through an etheration reactor. In the etheration reactor, isopropanol and isobutene are contacted with an Amberlyst 15® catalyst at a temperature which is controlled to between about 120° F. and 95° F. The temperature may be controlled by vaious means, and one preferred method is to use interbed quench; i.e., to withdraw a portion of the material between reactor beds, cool the reactants and then return the reactants to the top of the next bed in the etheration reactor. It has been determined that it is advantageous to control the reaction temperature to between about 50° and 200° F., and particularly to about 75° to 125° F. The reaction of isopropanol + isobutene to form t-butyl isopropyl ether is exothermic, and the temperature greatly affects the equilibrium constant (at 100° F., $K_{eq} = 10.0$, and at 150° F., $K_{eq} = 4.0$).

The effluent ether product is withdrawn from the etheration reactor at about 200 psig and 105° F. The raw ether product is passed to a rectifier column, wherein it is fractionated to obtain an overhead stream containing several thousand lbs/hr. of isobutane. This overhead stream is passed to the deisobutanizer column contained in etheration zone 16. The bottoms from the rectifier column consist primarily of ether and isopropanol. This ether-and-isopropanol stream is fed to an alcohol recycle fractionation column. Essentially all of the alcohol is distilled overhead in the alcohol recycle column and is then recycled back to the etheration reactor. The recycled isopropanol amounts to about 19,450 lbs./hr. The bottoms from the alcohol recycle column is primarily the product t-butyl isopropyl ether, amounting to about 31,500 lbs./hr., obtained from the net feed streams to the plant of about 17,240 lbs./hr. isopropanol and about 20,850 lbs./hr. isobutene.

Although various embodiments of the invention have been described, it is to be understood that they are meant to be illustrative only and not limiting. Certain features may be changed without departing from the spirit or scope of the invention. It is apparent that the present invention has broad application to the production of etherated gasolines by an integrated process, including dehydrogenating-cracking to obtain a propylene and isobutene mixture, separating the mixture, hydrating the propylene, and etherating the isopropanol with the isobutene produced in the dehydrogenation-cracking step. Accordingly, the invention is not to be construed as limited to the specific embodiments or examples discussed, but only as defined in the appended claims.

What is claimed is:

1. In a process for producing a high-octane gasoline by blending a hydrocarbon mixture of the gasoline range with an ether, the improvement which comprises:

a. thermally dehydrogenating-cracking isobutane to obtain a mixture of propylene and isobutene;
b. separating the mixture into an isobutene-rich stream and a propylene-rich stream;
c. hydrating with a solid acidic hydration catalyst the propylene-rich stream to obtain isopropanol;
d. etherating the isopropanol with the isobutene-rich stream to obtain t-butyl isopropyl ether; and
e. blending the t-butyl isopropyl ether with gasoline-boiling-range hydrocarbons.

* * * * *